US007008242B2

(12) United States Patent
Inoue

(10) Patent No.: US 7,008,242 B2
(45) Date of Patent: Mar. 7, 2006

(54) CONDUCTIVE CLIP

(75) Inventor: Yasuhiko Inoue, Toyonaka (JP)

(73) Assignee: Nifco Inc., Yokohama (JP)

( * ) Notice: Subject to any disclaimer, the term of this patent is extended or adjusted under 35 U.S.C. 154(b) by 0 days.

(21) Appl. No.: 11/148,294

(22) Filed: Jun. 9, 2005

(65) Prior Publication Data

US 2005/0277314 A1 Dec. 15, 2005

(30) Foreign Application Priority Data

Jun. 15, 2004 (JP) ..... 2004-176774

(51) Int. Cl.
*H01R 4/66* (2006.01)

(52) U.S. Cl. ..... 439/92; 439/268

(58) Field of Classification Search ..... 439/74, 439/75, 546, 547, 266, 268, 92, 441
See application file for complete search history.

(56) References Cited

U.S. PATENT DOCUMENTS 3,864,001 A * 2/1975 Millet ..... 439/547
4,381,878 A * 5/1983 Lechner et al. ..... 439/92
6,344,972 B1 * 2/2002 Estieule et al. ..... 361/753
6,821,133 B1 * 11/2004 Latal ..... 439/92

FOREIGN PATENT DOCUMENTS

JP 2002-15789 1/2002
JP 2002-25646 1/2002

* cited by examiner

*Primary Examiner*—Gary Paumen
*Assistant Examiner*—James R. Harvey
(74) *Attorney, Agent, or Firm*—Manabu Kanesaka

(57) ABSTRACT

A conductive clip includes a hollow cylindrical member having a flange at one edge thereof in an axial direction and an opening communicating in a radial direction at an intermediate portion thereof in the axial direction, and a conductive member having an axial elastic force generating piece facing an inner surface of the large diameter flange and a radial elastic force generating piece passing through the opening inwardly or outwardly. The conductive member is fitted to the hollow cylindrical member to be relatively movable in the axial direction. When the hollow cylindrical member moves outwardly relative to the conductive member, the radial elastic force generating piece is pushed by an inner edge of the opening in the radial direction, so that a free end of the radial elastic force generating piece moves outwardly or inwardly in the radial direction.

6 Claims, 5 Drawing Sheets

CONDUCTIVE CLIP

BACKGROUND OF THE INVENTION AND RELATED ART STATEMENT

The present invention relates to a conductive clip for fixing a printed circuit board to a metallic chassis and connecting an earth pattern formed on the printed circuit board to the metallic chassis.

Conventionally, a printed circuit board is fastened with a metallic fastening screw. An earth pattern of the printed circuit board is formed around an insertion hole, and a head of the metallic screw contacts the earth pattern, thereby connecting the circuit board to a chassis (chassis earth). However, workability of fastening a screw is relatively low. Patent Reference 1 has disclosed a fixing device having an engaging wing portion made of a highly conductive resin, so that earth connection is completed with one touch operation.

Patent Reference 1: Japanese Patent Publication (Kokai) NO. 2002-025646

In the fixing device disclosed in Patent Reference 1, the highly conductive resin has conductivity lower than that of metal, and relatively large creep deterioration. Accordingly, a contact pressure is not stable, and it is difficult to maintain sufficient conductivity for long time.

In view of the problems described above, an object of the present invention is to provide a conductive clip with steady long term conductivity capable of attaching with one touch operation.

Further objects and advantages of the invention will be apparent from the following description of the invention.

SUMMARY OF THE INVENTION

In order to attain the objects described above, a conductive clip includes a hollow cylindrical member (cylindrical body) having a large diameter flange at one end thereof in an axial direction and an opening communicating in a radial direction at an intermediate portion thereof in the axial direction; and a conductive member having an axial elastic force generating piece facing an inner surface of the large diameter flange and a radial elastic force generating piece passing through the opening inwardly or outwardly. The conductive member is fitted to the hollow cylindrical member to be relatively movable in the axial direction. When the conductive member and the hollow cylindrical member move relatively in the axial direction, the radial elastic force generating piece is pushed by an inner edge of the opening in the radial direction, so that a free end of the radial elastic force generating piece moves outwardly or inwardly in the radial direction.

According to the present invention, the conductive clip may include each of the axial elastic force generating piece and the radial elastic force generating piece as a singular member. Further, a concave portion may be formed in a surface of the large diameter flange facing the axial elastic force generating piece for providing a space so that the axial elastic force generating piece is accommodated therein.

According to the present invention, the hollow cylindrical member is fitted into a convex portion or a concave portion formed in a chassis through a hole formed in a printed circuit board, so that the large diameter flange holds the printed circuit board not to come out, thereby attaching the printed circuit board to the chassis with one touch operation. At this time, the axial elastic force generating piece is placed between the flange and an earth pattern, and the radial elastic force generating piece abuts against an outer circumference surface of the convex portion of the chassis or an inner circumference surface of the concave portion of the chassis, thereby forming an earth circuit.

The radial elastic force generating piece is strongly held due to an axial force of the axial elastic force generating piece, thereby strongly fixing the conductive clip to the chassis. When only the hollow cylindrical member is pulled out in the axial direction, the radial elastic force generating piece is pushed against the inner edge of the opening in the axial direction, so that the radial elastic force generating piece moves away from the outer circumference surface of the convex portion of the chassis or the inner circumference surface of the concave portion of the chassis. Accordingly, it is possible to easily remove the printed circuit board from the chassis.

When the conductive clip may include each of the axial elastic force generating piece and the radial elastic force generating piece as a singular member, it is possible to reduce an amount of a material. Further, the concave portion may be formed in the surface of the large diameter flange facing the axial elastic force generating piece for providing a space so that the axial elastic force generating piece is accommodated therein. Accordingly, when the conductive clip is pushed in until the flange abuts against the printed circuit board, the axial elastic force generating piece does not generate a permanent deformation due to the space for the axial elastic force generating piece. Accordingly, it is possible to reduce creep deterioration, thereby obtaining an ability of repeating attachment and stable conductivity for long time.

DETAILED DESCRIPTION OF PREFERRED EMBODIMENT

Hereunder, embodiments of the present invention will be described with accompanying drawings.

First Embodiment

Figure 1:
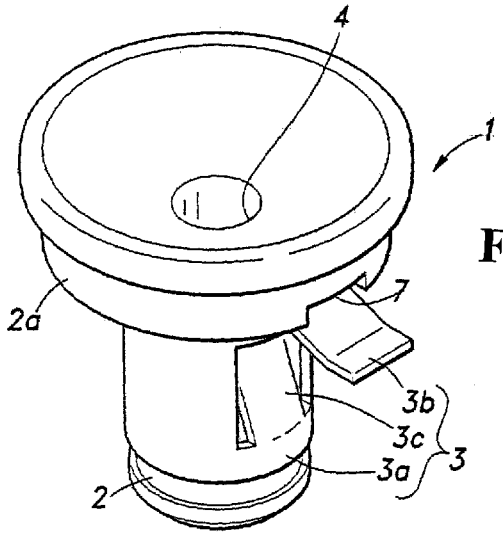
FIG. 1 is a perspective view showing a conductive clip according to a first embodiment of the present invention.
Figure 2:
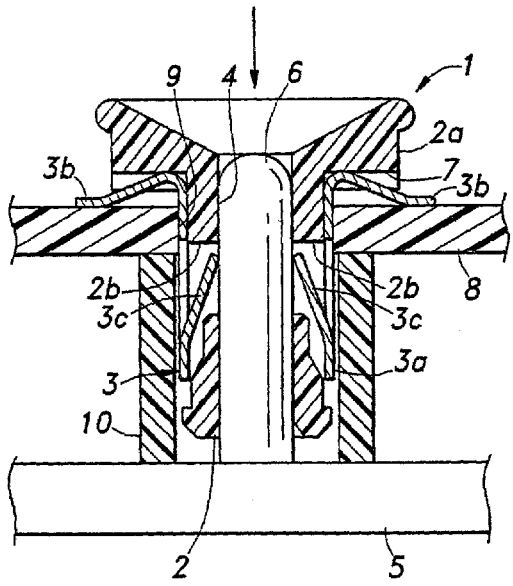
FIG. 2 is a longitudinal sectional view showing the conductive clip in an attached state according to the first embodiment of the present invention.
Figure 3:
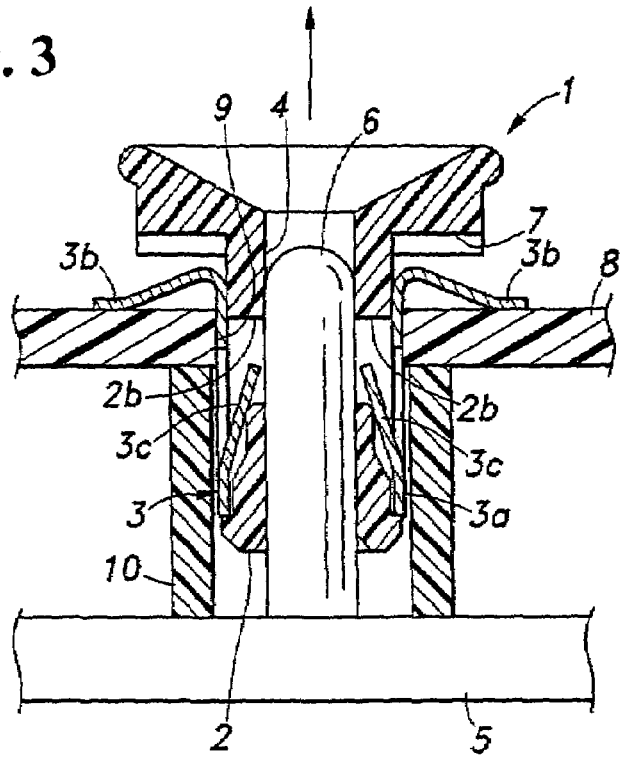
FIG. 3 is a longitudinal sectional view showing the conductive clip in a removing state according to the first embodiment of the present invention.

FIGS. 1 to 3 are views showing a conductive clip according to a first embodiment of the present invention. A conductive clip 1 fixes a printed circuit board to a metal chassis, and includes a cylindrical body 2 made of a synthetic resin and a conductive member 3 made of metal. The cylindrical body 2 is formed of a synthetic resin with injection molding, and has a large diameter flange 2*a* at an end thereof. As shown in FIGS. 2 and 3, a stud pin 6 integrally provided on a chassis 5 is inserted into a through-hole 4 formed in the cylindrical body 2 at a center thereof along an axial direction. Concave portions 7 with a rectangular cross section are formed in a rear surface of the flange 2*a* along a radial direction. Two openings 2*b* are formed in the cylindrical body 2 at intermediate positions thereof in the axial direction. The openings 2*b* generally have a rectangle shape with a long side along the axial direction and penetrate in the radial direction along a diameter-of the cylindrical body 2.

The conductive member 3 is formed of a thin plate made of beryllium copper having conductivity and elasticity. The conductive member 3 includes a main portion 3*a* with a cylindrical shape; two axial elastic force generating pieces 3*b* extending from an end of the main portion 3*a* in a radial direction; and two radial elastic force generating pieces 3*c* formed by cutting a part of the main portion 3*a* in an inverted U-shape and pushing free ends inwardly. In the conductive member 3, the main portion 3*a* is fitted onto an outer circumference of the cylindrical body 2, and the axial elastic force generating pieces 3*c* face the concave portions 7 of the flange 2*a* of the cylindrical body 2. Free ends of the radial elastic force generating pieces 3*c* are inserted obliquely and upwardly into the openings 2*b* formed in the cylindrical body 2 at intermediates portion thereof in the axial direction. Further, the free ends of the radial elastic force generating pieces 3*c* are inserted slightly into the through-hole 4 in a normal state.

Figure 4:
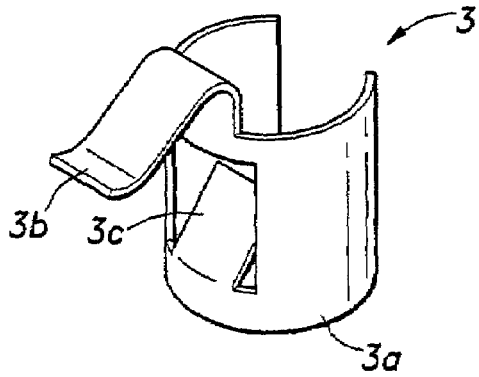
FIG. 4 is a perspective view showing a modified example of a conductive member.

The axial elastic force generating pieces 3*b* and the radial elastic force generating pieces 3*c* are preferably disposed at positions equally dividing a circumference of the main portion 3*a* in view of a force balance. As shown in FIG. 4, just each one of the axial elastic force generating piece 3*b* and the radial elastic force generating piece 3*c* may be formed on the main portion 3*a* with a C shape surrounding the outer circumference of the cylindrical body 2, thereby saving a material. The openings 2*b* of the cylindrical body 2 and the concave portions 7 correspond to the axial elastic force generating pieces 3*b* and the piece radial elastic force generating pieces 3*c*, respectively.

An insertion hole 9 of the conductive clip 1 is formed in a printed circuit board 8, and an earth pattern is formed on an upper surface of the printed circuit board 8 around the insertion hole 9 of the conductive clip 1 similar to a conventional one fixed with a screw (not shown).

When the printed circuit board 8 is fixed to the chassis 5, a collar 10 is loosely fitted on the stud pin 6 of the chassis 5. An end of the stud pin 6 is inserted into the insertion hole 9 of the conductive clip 1 for the printed circuit board 8. Then, the end of the stud pin 6 appearing at a center of the insertion hole 9 of the conductive clip 1 is fitted into the through-hole 4 formed in the cylindrical body 2 of the conductive clip 1. An end face of the cylindrical body 2 with a concave shape in the axial direction (an arrow direction) is pushed in with a finger.

The two axial elastic force generating pieces 3*c* formed on the conductive member 3 are inclined upwardly, and obliquely toward inside. Accordingly, the free ends of the axial elastic force generating pieces 3*c* abut against the outer circumference surface of the stud 6, and the axial elastic force generating pieces 3*c* elastically deform outwardly in the radial direction, thereby easily attaching the conductive clip 1 to the stud pin 6. In this state, the axial elastic force generating pieces 3*b* contact the earth pattern on the upper surface of the printed circuit board 8, and the radial elastic force generating pieces 3*c* contact the outer circumference of the stud 6, thereby establishing chassis earth.

In this state, the axial elastic force generating pieces 3*b* elastically push the printed circuit board 8 downwardly, so that the main portion 3*a* is pushed upwardly with a reaction force. Due to the upward reaction force, the free ends of the radial elastic force generating pieces 3*c* are pressed inwardly against the outer circumference of the stud pin 6, so that the conductive clip 1 dose not become loose by vibration.

Figure 5:
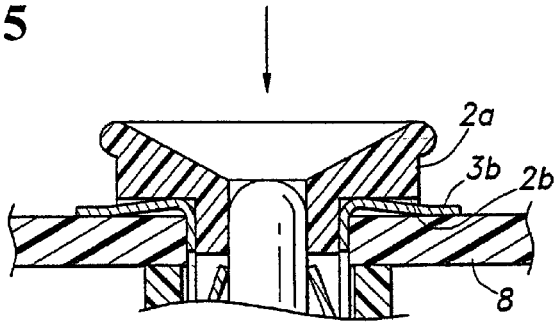
FIG. 5 is a longitudinal sectional view showing the conductive clip in a state that the conductive clip is pushed against a printed circuit board.

As shown in FIG. 5, when the cylindrical body 2 is pushed in completely until a rear surface of the flange 2*a* abuts against the surface of the printed circuit board 8, the axial elastic force generating pieces 3*b* are accommodated in the concave portions 7 formed in the rear surface of the flange 2*a*. That is, when the conductive clip 1 is pushed in completely, the axial elastic force generating pieces 3*b* deform and are accommodated in the spaces. Accordingly, the axial elastic force generating pieces 3*b* does not have permanent strain, and it is possible to maintain steady contact pressure for long time, thereby obtaining an ability of repeating attachment and stable conductivity.

When the conductive clip 1 is detached, as shown in FIG. 3, the large diameter flange 2*a* of the cylindrical 2 is pulled upwardly (an arrow direction). An lower edge of the opening 2*b* retaining the radial elastic force generating pieces 3*c* of the conductive member 3 abuts against inner surfaces of the radial elastic force generating pieces 3*c*, so that the radial elastic force generating pieces 3*c* are pushed outwardly. Accordingly, the free ends of the radial elastic force generating pieces 3*c* move away from the outer circumference surface of the stud pin 6, thereby easily detaching the conductive clip 1 from the stud pin 6. As described above, it is possible to easily repeat the attachment and detachment.

Second Embodiment

Figure 6:
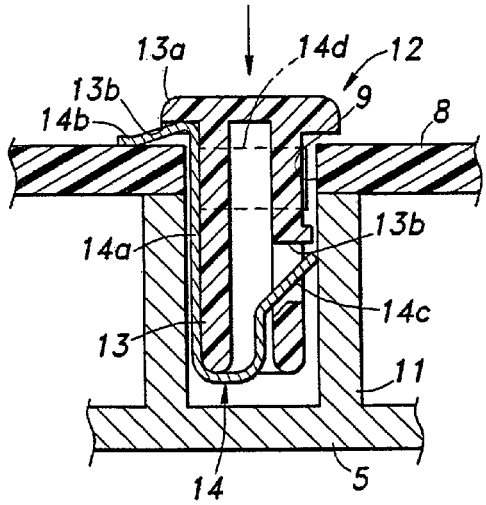
FIG. 6 is a longitudinal sectional view showing a conductive clip in an attached state according to a second embodiment of the present invention.
Figure 7:
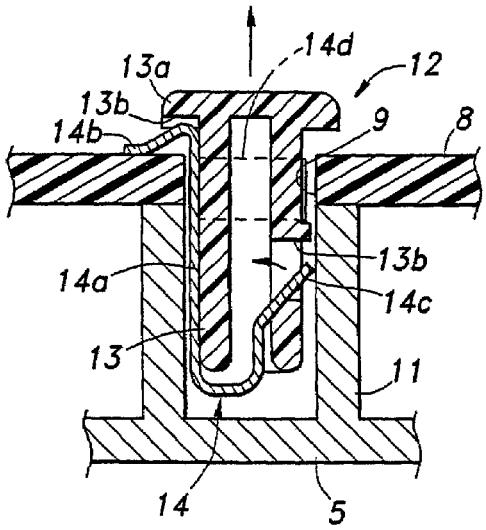
FIG. 7 is a longitudinal sectional view showing the conductive clip in the removing state according to of the second embodiment the present invention.

FIGS. 6 and 7 are views showing a conductive clip according to a second embodiment of the prevent invention. In the second embodiment, a conductive clip 12 is fitted into a tubular boss 11 provided on the chassis 5. Similar to the first embodiment, the conductive clip 12 is formed of a cylindrical body 13 made of a synthetic resin and a conductive member 14 made of metal.

The cylindrical body 13 is formed of a synthetic resin with injection molding. A large diameter flange 13*a* is formed at an end of the cylindrical body 13, and a hole 15 with a lower open end is formed at a center of the cylindrical body 13. An opening 13*b* with a rectangle shape is formed in the cylindrical body 13 at an intermediate portion thereofin an axial direction. Similar to the first embodiment above, a concave portion 16 is formed in a rear surface of the large diameter flange 13*a* along a radius line thereof.

Figure 8:
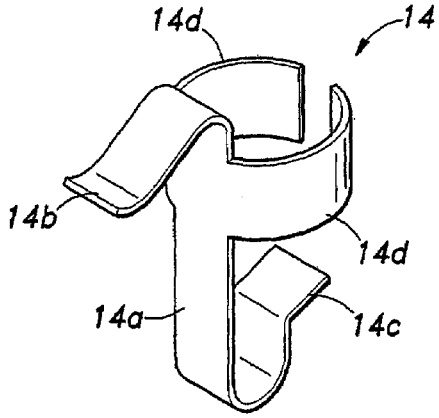
FIG. 8 is a perspective view showing a conductive member according to the second embodiment.

As shown in FIG. 8, the conductive member 14 is formed of a beryllium copper plate with a J shape. The conductive member 14 includes an axial elastic force generating piece 14*b* extending outwardly from an end of an elongated axial portion 14*a*; a radial elastic force generating piece 14*c* extending obliquely and outwardly from the other end of the elongated axial portion 14*a*; and holding portions 14*d* with a curved shape extending toward both sides from a portion near a base portion of the axial elastic force generating piece 14*b*.

Figure 9:
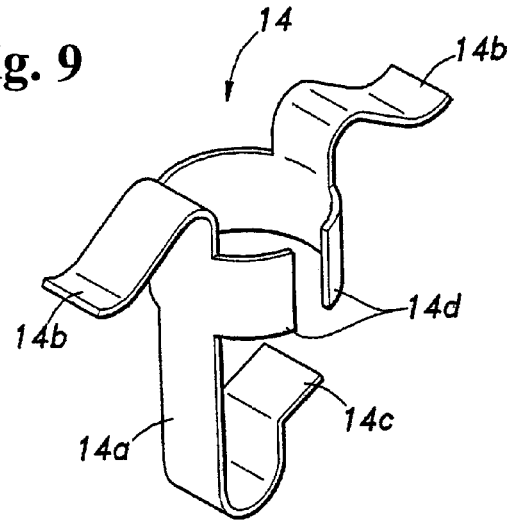
FIG. 9 is a perspective view showing a modified example of the conductive member according to the second embodiment.

In the conductive member 14, the axial portion 14*a* is fitted onto an outer circumference of the cylindrical body 12 in an axial direction, and the holding portions 14*d* hold the outer circumference of the cylindrical body 12. The axial elastic force generating piece 14*b* faces the concave portion 16 formed in the rear surface of the large diameter flange 13*a* of the cylindrical body 12. The radial elastic force generating piece 14*c* is inserted upwardly into the blind hole 15 from a lower end thereof, so that a free end of the radial elastic force generating piece 14*c* projects obliquely and upwardly through the opening 13*b* formed in the cylindrical body 12 at the intermediate portion thereof in the axial direction. The free end of the radial elastic force generating piece 14*c* projects slightly from an outer circumference surface of the cylindrical body 13 in a normal state. As shown in FIG. 9, two axial elastic force generating pieces 14*b* may be provided to extend from the holding portions 14*d* in opposite directions.

In the second embodiment, the printed circuit board 8 is placed on an upper end surface of the tubular boss 11 formed on the chassis 5, and the conductive clip 12 is inserted into an inner circumference surface of the tubular boss 11 through the insertion hole 9 for the conductive clip 12 formed in the printed circuit board 8. The radial elastic force generating piece 14*c* is inclined obliquely and upwardly. When the free end of the radial elastic force generating piece 14*c* abuts against the inner circumference surface of the tubular boss 11, the radial elastic force generating piece 14*c* deforms inwardly, thereby easily inserting the conductive clip 12 into the inner circumference of the tubular boss 11. Similar to the first embodiment, when the conductive clip 12 is pushed in completely, the free end of the axial elastic force generating piece 14*b* is accommodated in the concave portion 16.

When the conductive clip 12 is detached, the large diameter flange 13*a* of the cylindrical body 13 is pulled upwardly. Accordingly, a lower end of the opening 13*b* of the cylindrical body 13 pushes the radial elastic force generating piece 14*c* to move away from the inner circumference surface of the tubular boss 11, thereby easily detaching the conductive clip 12.

In the embodiments of the present invention described above, the earth pattern of the printed circuit board is connected to the chassis. The invention is not limited to the earth pattern of the printed circuit board, and it is possible to connect a pressure terminal to an earth terminal.

The disclosure of Japanese Patent Application No. 2004-176774, filed on Jun. 15, 2004, is incorporated in the application.

While the invention has been explained with reference to the specific embodiments of the invention, the explanation is illustrative and the invention is limited only by the appended claims.

What is claimed is:

1. A conductive clip comprising:

a hollow cylindrical member having a flange at one axial end thereof, and an opening communicating in a radial direction at an axial intermediate portion thereof, and a conductive member having an axial elastic force generating piece facing a rear surface of the flange and a radial elastic force generating piece passing through the opening inwardly or outwardly, said conductive member being attached to the hollow cylindrical member to be movable in an axial direction so that when the cylindrical member is moved away from the conductive member, the radial elastic force generating piece is pushed by an inner edge of the opening to move a free end of the radial elastic force generating piece outwardly or inwardly in the radial direction.

2. A conductive clip according to claim 1, wherein each of said axial elastic force generating piece and said radial elastic force generating piece includes one member, respectively.

3. A conductive clip according to claim 1, wherein said flange includes a concave portion at a surface facing the axial elastic force generating piece for accommodating the axial elastic force generating piece therein.

4. A conductive clip according to claim 1, wherein said hollow cylindrical member includes an axial hole therein, and said conductive member includes a main portion slidably disposed outside the cylindrical member.

5. A conductive clip according to claim 4, wherein said radial elastic force generating piece is inserted into the axial hole through the opening.

6. A conductive clip according to claim 4, wherein said radial elastic force generating piece is inserted into the axial hole from a lower end of the cylindrical member and projects outwardly through the opening.

* * * * *